US009494918B2

(12) United States Patent
Kubo

(10) Patent No.: US 9,494,918 B2
(45) Date of Patent: Nov. 15, 2016

(54) IMAGE FORMING APPARATUS

(71) Applicant: CANON KABUSHIKI KAISHA, Tokyo (JP)

(72) Inventor: Shinji Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/965,082

(22) Filed: Dec. 10, 2015

(65) Prior Publication Data

US 2016/0170371 A1 Jun. 16, 2016

(30) Foreign Application Priority Data

Dec. 16, 2014 (JP) ..... 2014-254469

(51) Int. Cl.
*G03G 15/00* (2006.01)
*G03G 21/18* (2006.01)

(52) U.S. Cl.
CPC ..... *G03G 21/1842* (2013.01)

(58) Field of Classification Search
CPC ..... G03G 21/1647; G03G 21/1633; G03G 2221/1684; G03G 21/1623; G03G 21/1676
USPC ..... 399/110
See application file for complete search history.

(56) References Cited

U.S. PATENT DOCUMENTS

2004/0234293 A1* 11/2004 Karakama ..... G03G 21/1846 399/111
2006/0093398 A1* 5/2006 Hayakawa ..... G03G 21/186 399/111
2011/0299882 A1* 12/2011 Tanaami ..... G03G 15/326 399/110

FOREIGN PATENT DOCUMENTS

JP 2005091708 A 4/2005
JP 2007163880 A 6/2007

OTHER PUBLICATIONS

Machine translation of Tanaka JP 2007-163880 A, publication date: Jun. 28, 2007.*
Machine translation of Goto JP 03252667 A, publication date: Nov. 11, 1991.*

* cited by examiner

*Primary Examiner* — Walter L Lindsay, Jr.
*Assistant Examiner* — Frederick Wenderoth
(74) *Attorney, Agent, or Firm* — Canon U.S.A., Inc. IP Division

(57) ABSTRACT

An image forming apparatus includes a restricting member configured to prevent a cartridge, which is inserted through an opening portion of an apparatus main body, from being inserted to an image forming position, the opening portion being formed by opening of a door, a pressing member configured to press the cartridge in a direction in which the cartridge is mounted at the image forming position, and a driving unit configured to move the restricting member. The cartridge is fixed at a transportation position by the restricting member and the pressing member when the image forming apparatus is transported, and the restricting member is moved to a retracted position by the driving unit and the cartridge is movable to the image forming position when the image forming apparatus is used.

7 Claims, 6 Drawing Sheets

IMAGE FORMING APPARATUS

BACKGROUND OF THE INVENTION

1. Field of the Invention

The present invention is related to an image forming apparatus.

2. Description of the Related Art

An image forming apparatus that performs an electrophotographic image forming process employs a configuration in which an electrophotographic photosensitive member and a process unit that processes the electrophotographic photosensitive member are integrated into a process cartridge (hereinafter, referred to as a cartridge) that is detachably attached to a main body of the image forming apparatus.

With the cartridge, a user himself/herself can maintain the image forming apparatus without the help from a service person, whereby much better service operability can be achieved. Thus, the cartridge is widely used in image forming apparatuses.

In a conventional packed form of the image forming apparatus employing the process cartridge system, a main body of the image forming apparatus and the cartridge are packed and fixed separately. Then, the image forming apparatus is transported in a state in which interface portions between the cartridge and the main body (contact portions of an electrophotographic photosensitive member (hereinafter, referred to as a photosensitive drum) and a transfer roller, electrical contact portions, and the like) are protected. Because the main body of the image forming apparatus and the cartridge are each separately packed, the packed form is large and thus requires high cost for packing materials and transportation.

In recent years, improvement in transportation efficiency, which is achieved by reducing packing members and downsizing the packed form, has attracted attention in view of environmental protection. Thus, techniques of transporting the image forming apparatus with the cartridge fixed in the main body have been developed.

For example, Japanese Patent Application Laid-Open No. 2005-91708 and Japanese Patent Application Laid-Open No. 2007-163880 discuss configurations in which a dedicated fixing or packing member is used to fix the cartridge at an intermediate portion of a path through which the cartridge is mounted to the main body of the image forming apparatus, so that the interface portions of, for example, the photosensitive drum, the transfer roller, and the electrical contact portions, and the like can be separated from each other.

Unfortunately, the conventional examples discussed in Japanese Patent Application Laid-Open No. 2005-91708 and Japanese Patent Application Laid-Open No. 2007-163880 have the following issues.

When installing the apparatus, the user needs to take out the cartridge from the main body of the image forming apparatus, and remove the fixing member attached to the cartridge and the packing member in the apparatus main body. Thus, a large number of preparation processes is required before the user can use the image forming apparatus, and thus user friendliness is low. Furthermore, high cost is required for using the dedicated fixing and packing members for fixing the cartridge.

SUMMARY OF THE INVENTION

The present invention is made in view of the current situation described above, and is directed to a technique in which the image forming apparatus can be transported with the cartridge mounted in the main body, and the cartridge can be surely mounted at an image forming position without requiring the user to perform a special operation when the image forming apparatus is used.

According to an aspect of the present invention, an image forming apparatus that is transportable in a state in which a cartridge that is detachably attached to a main body of the image forming apparatus is mounted, includes an opening and closing member that is able to be opened and closed when the cartridge is attached and detached, a restricting member configured to prevent the cartridge, which is inserted through an opening portion of the main body, from being inserted to an image forming position at which the cartridge performs image forming, the opening portion being formed by an opening of the opening and closing member, a driving unit configured to move the restricting member, and a pressing unit configured to press the cartridge in a direction in which the cartridge is mounted at the image forming position, wherein the cartridge is, when the image forming apparatus is transported, fixed at a transportation position by the restricting member and the pressing unit, and wherein the restricting member is, when the image forming apparatus is used, moved to a retracted position by the driving unit and the cartridge is movable to the image forming position.

Further features of the present invention will become apparent from the following description of exemplary embodiments with reference to the attached drawings.

DESCRIPTION OF THE EMBODIMENTS

Exemplary embodiments of the present invention are described in detail below with reference to the drawings.

Figure 3A:
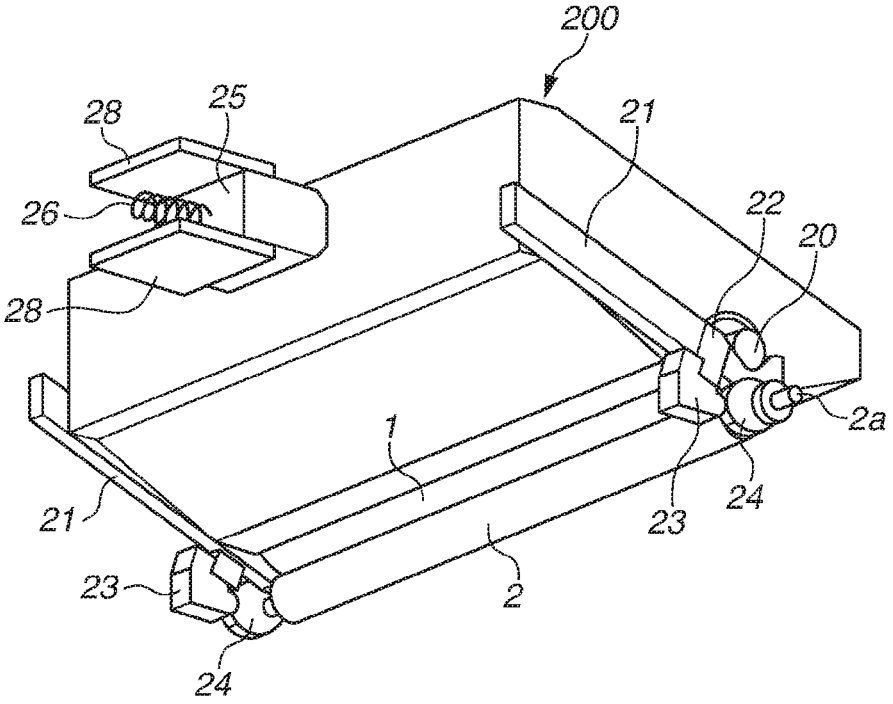
FIGS. 3A and 3B are perspective views each illustrating the configuration in which the image forming apparatus according to the first exemplary embodiment holds the cartridge.
Figure 3B:
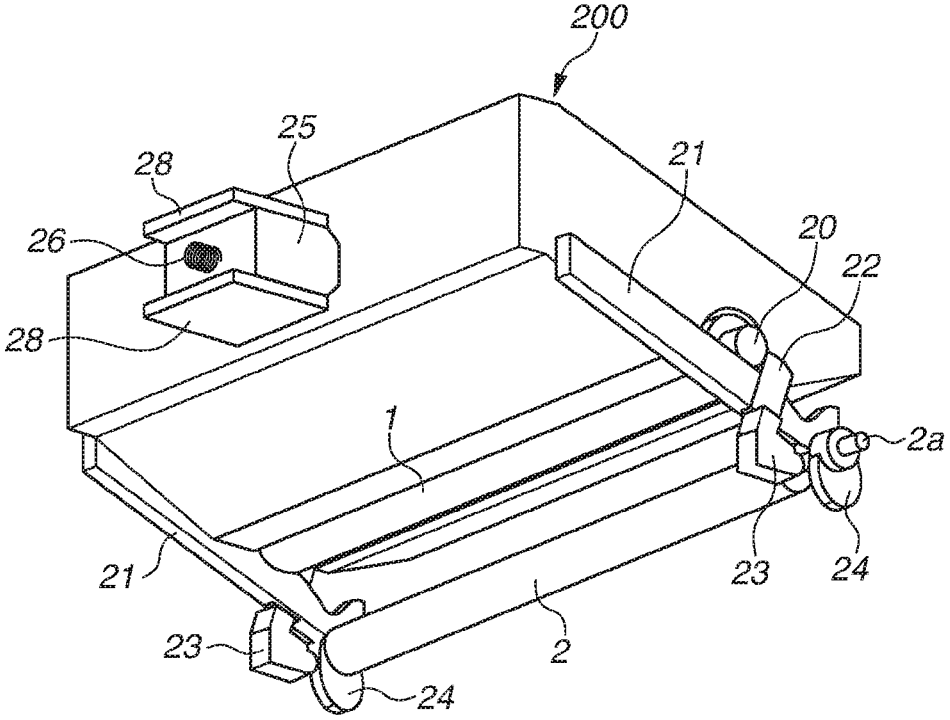
Figure 4:
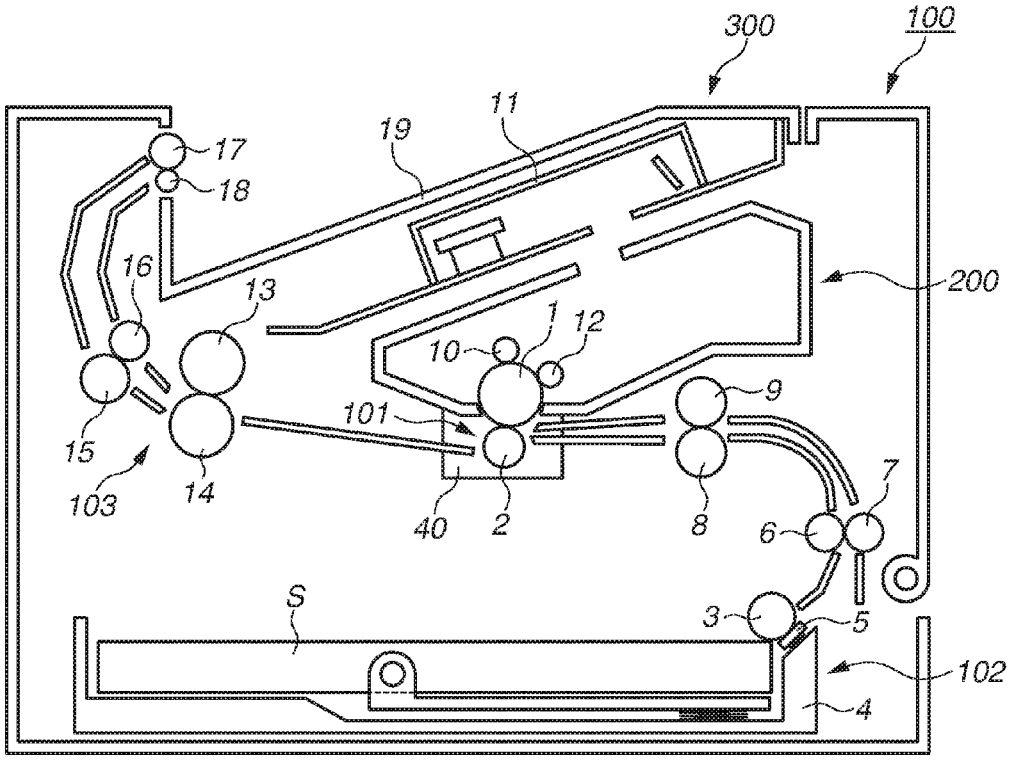
FIG. 4 is a cross-sectional view illustrating a schematic configuration of the image forming apparatus according to the first exemplary embodiment.

A configuration of an image forming apparatus according to a first exemplary embodiment is described with reference to FIGS. 1A and 1B to FIG. 4. FIG. 4 is a diagram illustrating a schematic configuration of a laser beam printer, which is an example of the image forming apparatus according to the first exemplary embodiment. The image forming apparatus is not limited to the laser beam printer. The image forming apparatus forms an image on a recording medium through an image forming method using electrophotography. Examples of the image forming apparatus include an electrophotographic copier, an electrophotographic printer (for example, a laser beam printer, a light emitting diode (LED) printer, or the like), a facsimile apparatus, a word processor, and the like. For example, the present invention may be also applied to other image forming apparatuses, such as a copier, a facsimile apparatus, or a multifunction peripheral having functions of these.

As illustrated in FIG. 4, an image forming apparatus 100 includes an image forming unit 101 that forms an image on a sheet S and a sheet feeding device 102 that feeds the sheet S to the image forming unit 101. The image forming apparatus 100 further includes, for example, a fixing device 103 that applies heat and pressure to a toner image formed on the sheet S by the image forming unit 101 to fix the image.

The image forming unit 101 includes a main body 300 (hereinafter, referred to as an apparatus main body) of the image forming apparatus 100 and a cartridge 200 that is detachably attached to the apparatus main body 300. Thus, the image forming apparatus 100 includes the apparatus main body 300 and the cartridge 200. The image forming apparatus 100 includes a transfer roller 2 that is disposed in such a manner that the transfer roller 2 faces a photosensitive drum 1 that is an image bearing member constituting a part of the image forming unit 101 in the cartridge 200.

When a control unit (not illustrated) issues a print signal, a feeding roller 3 rotates, only at the time of feeding, whereby the sheets S stacked on a sheet cassette 4 are separated by a separation pad 5 to be fed one by one from the top. Then, each sheet S is further conveyed to a downstream side in a sheet conveyance direction while being nipped by a conveyance roller pair including a conveyance roller 6 and a conveyance idler roller 7 for conveying the sheet S.

Then, the sheet S being conveyed is temporarily stopped to be positioned with respect to the toner image formed on the photosensitive drum 1. For the processing, the sheet S is conveyed toward the downstream side in the sheet conveyance direction while being nipped by a registration roller pair including a registration roller 8 and a registration idler roller 9, to be conveyed to the image forming unit 101.

Meanwhile, a surface of the photosensitive drum 1, uniformly charged by a charging roller 10 serving as a charging device, is irradiated with a laser beam from a laser scanner unit 11 based on image information received together with a print command. Thus, an electrostatic latent image is formed on the surface of the photosensitive drum 1.

The electrostatic latent image is developed by a developing roller 12 serving as a developing device, whereby the toner image is formed on the surface of the photosensitive drum 1. The toner image formed on the surface of the photosensitive drum 1 is transferred onto the sheet S conveyed to the nip portion between the photosensitive drum 1 and the transfer roller 2. The photosensitive drum 1 and the transfer roller 2 are driven by a driving unit 40 disposed in the apparatus main body 300, whereby the conveyance of the sheet S and the sequential transferring of the toner image are performed.

The sheet S, on which the toner image has been transferred, is conveyed to the fixing device 103, and is guided to a nip portion, in the fixing device 103, between a heating roller 13 and a pressing roller 14 that presses the heating roller 13. The toner image that has been transferred on the surface of the sheet S is heated and pressed while the sheet S is passing through the nip portion, and thus is fixed on the sheet S.

Then, the sheet S that has passed through the fixing device 103 is conveyed by a conveyance roller pair including a conveyance roller 15 and a conveyance idler roller 16, and then is discharged onto a discharge tray 19 by a discharge roller pair including a discharging roller 17 and a discharging idler roller 18. Thus, an image is formed on the sheet S.

Figure 1A:
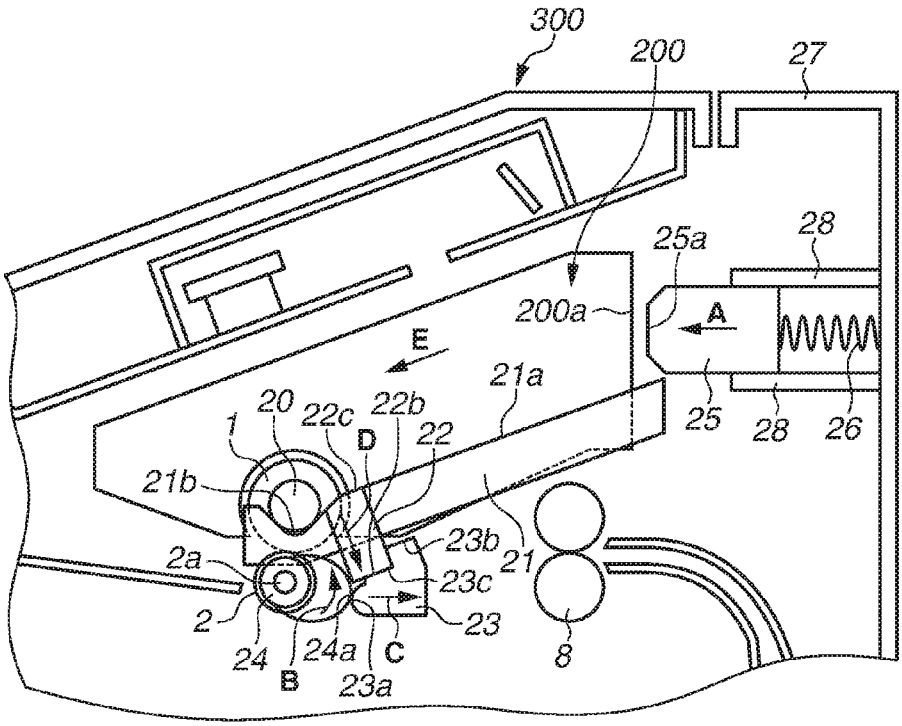
FIGS. 1A and 1B are schematic cross-sectional views each illustrating a configuration in which an image forming apparatus according to a first exemplary embodiment holds a cartridge.
Figure 1B:
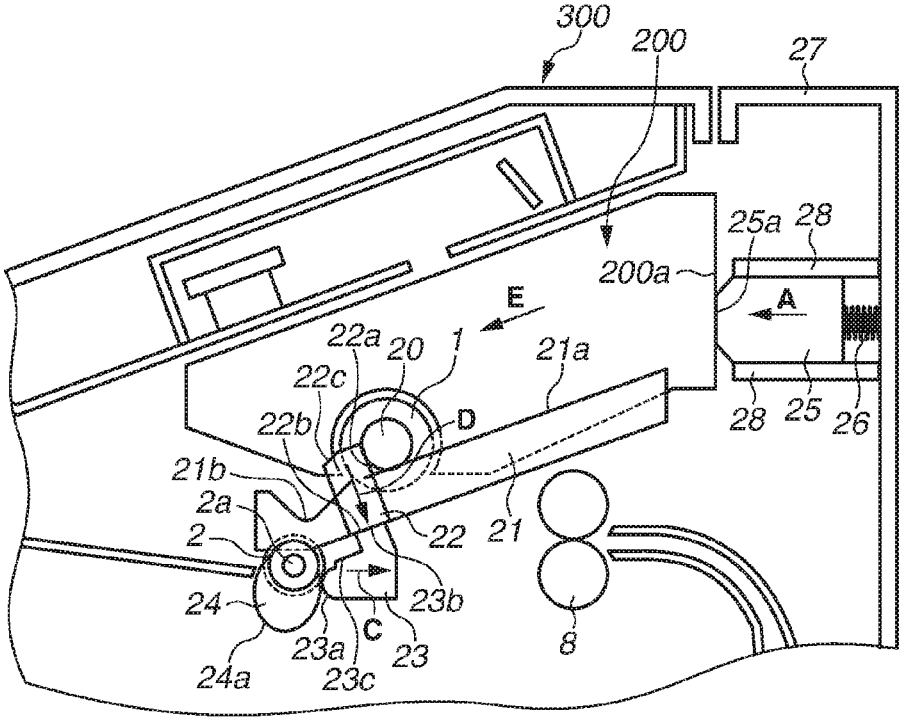
Figure 2A:
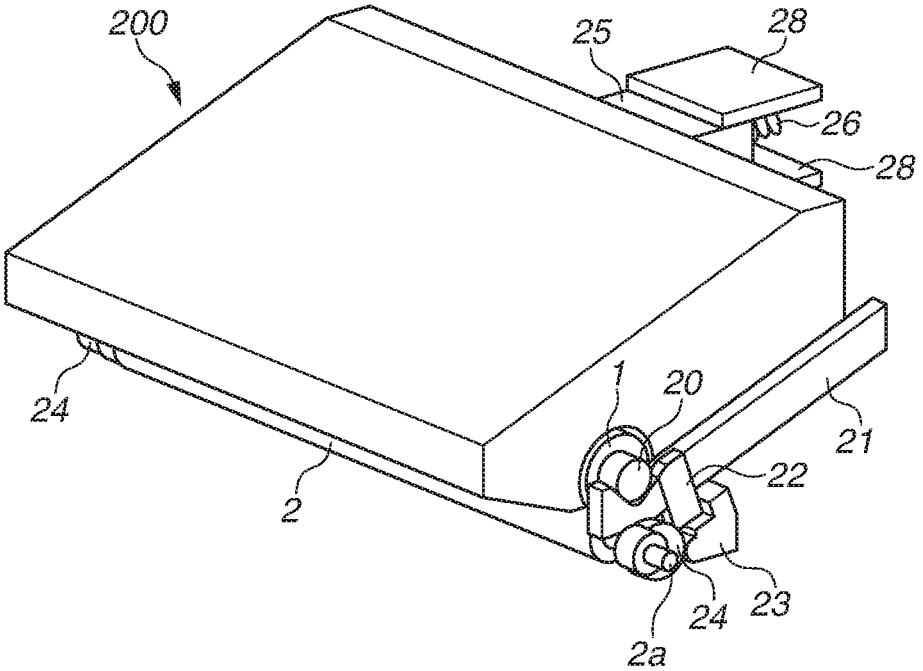
FIGS. 2A and 2B are perspective views each illustrating the configuration in which the image forming apparatus according to the first exemplary embodiment holds the cartridge.
Figure 2B:
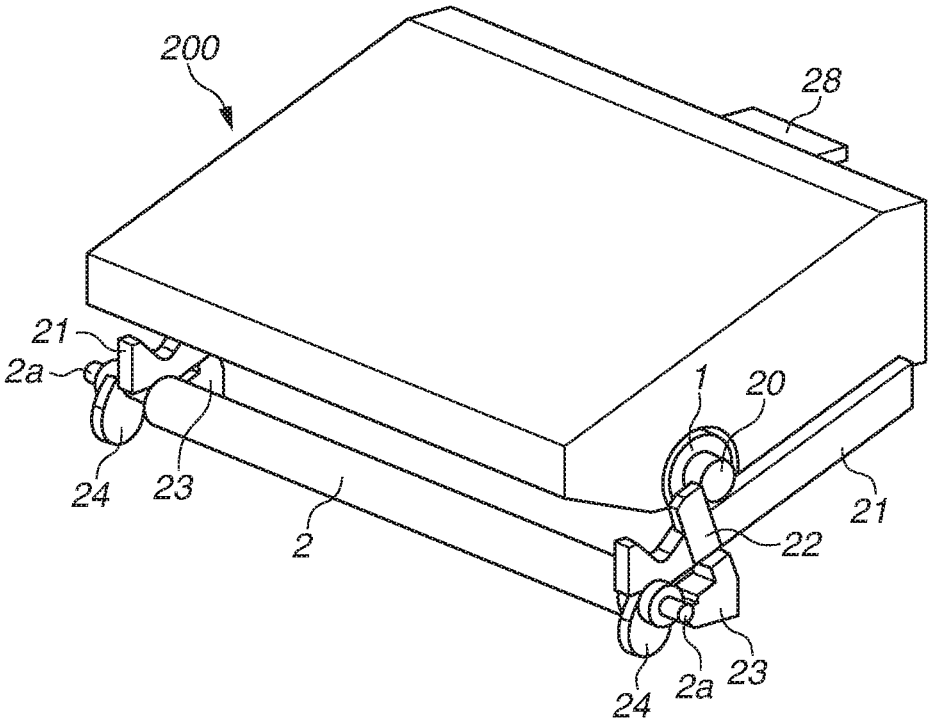

Next, a configuration in which the apparatus main body 300 holds the cartridge 200 will be described with reference to FIGS. 1A and 1B to FIGS. 3A and 3B. FIGS. 1A and 1B are schematic cross-sectional views each illustrating the configuration in which the apparatus main body 300 holds the cartridge 200 according to the present exemplary embodiment. FIG. 1A illustrates a state of when the image forming apparatus 100 is used, and FIG. 1B illustrates a state of when the image forming apparatus 100 is transported. FIGS. 2A, 2B, 3A, and 3B are perspective views each illustrating the feature portion illustrated in FIG. 1. FIGS. 2A and 3A each illustrate the state of when the image forming apparatus 100 is used, and FIGS. 2B and 3B each illustrate the state of when the image forming apparatus 100 is transported.

First of all, a positioning configuration for the cartridge 200 is described. As illustrated in FIG. 1A, the cartridge 200 includes positioning bosses 20 on both ends in an axial direction of the photosensitive drum 1. In the apparatus main body 300, guide members 21 are disposed on both sides of the cartridge 200. The guide members 21 guide the cartridge 200 when the cartridge 200 is mounted to the apparatus main body 300. The positioning bosses 20 are positioned by being in contact with recesses 21*b* of the guide members 21, whereby the cartridge 200 is mounted at an image forming position with the photosensitive drum 1 in contact with the transfer roller 2.

Next, the configuration in which the apparatus main body 300 holds the cartridge 200 when the image forming apparatus 100 is transported will be described with reference to FIG. 1B. Each guide member 21 is provided with a guide surface 21*a*. When the cartridge 200 is mounted, a door 27 (opening and closing member) that can be opened or closed with respect to the apparatus main body 300 is opened, and the cartridge 200 is inserted into the apparatus main body 300 through an opening portion thus formed. The cartridge 200 is mounted in such a manner that the positioning bosses 20 are guided along the guide surfaces 21*a*. The cartridge 200 that has been inserted is prevented from moving toward a downstream side E in a mounting direction by a restricting member 22. The restricting member 22 is attached to the apparatus main body 300 and can move in a direction indicated by an arrow D that intersects with the guide surface 21*a* of the guide member 21. A link member 23 is disposed on the lower side of the restricting member 22 and is held by the apparatus main body 300 in such a manner as to be movable in a direction indicated by an arrow C that intersects with the direction indicated by the arrow D. When the image forming apparatus 100 is transported, a surface 22*b* of the restricting member 22 is in contact with and thus is supported by a surface 23*b* of the link member 23, so that movement in the direction indicated by the arrow D is restricted.

On shaft portions 2*a* on both ends of the transfer roller 2, cams 24 that move in conjunction with the transfer roller 2 are provided. As illustrated in FIGS. 2A, 2B, 3A, and 3B, the restricting members 22, the link members 23, and the cams 24 are provided on both sides of the cartridge 200, as in the case of the guide members 21. When the cartridge 200 is positioned at a transportation position as illustrated in FIG. 1B so that the image forming apparatus 100 can be transported with the cartridge 200 mounted in the apparatus main body 300, the link members 23 come into contact with the cams 24 with their own weight or by being biased by a biasing unit such as a spring.

A pressing member 25 that presses a surface 200*a* of the cartridge 200 on the downstream side E in the mounting direction is provided to the door 27. A compression spring 26 is disposed between the pressing member 25 of the apparatus main body 300 and the door 27 to bias the pressing member 25 in a direction indicated by an arrow A toward the downstream side E in the mounting direction. The pressing member 25 is movable in the direction indicated by the arrow A by being guided by a rail member 28 provided to the door 27.

With the configuration described above, the positioning bosses 20 of the cartridge 200, which is pressed by the pressing member 25 toward the downstream side E in the mounting direction by the pressing member 25, come into contact with the surfaces 22*a* of the restricting members 22. As a result, the cartridge 200 is held at an intermediate portion in a mounting path at which the photosensitive drum 1 and the transfer roller 2 are not in contact with each other. When the surface 200*a* of the cartridge 200 is pressed in the direction indicated by the arrow A by the pressing member 25 as described above, the cartridge 200 is firmly fixed at the transportation position, which is at an intermediate portion of the mounting path, that is, the guide member 21.

Next, an operation of pushing the cartridge 200 when the image forming apparatus 100 is used is described with reference to FIG. 1. When a user installs the apparatus main body 300, and turns on the image forming apparatus 100, the transfer roller 2 is rotated by the driving unit 40. The cams 24 also rotate in a direction indicated by an arrow B in conjunction with the rotation of the transfer roller 2. When the surfaces 24*a* of the cams 24 press the surfaces 23*a* of the link members 23, the link members 23 move in the direction indicated by the arrow C. By the movement of the link members 23, the restricting members 22 can be retracted. More specifically, the surfaces 23*b* of the link members 23 and the surfaces 22*b* of the restricting members 22 are separated from each other, whereby the restricting members 22 translate in the direction indicated by the arrow D with their own weight. The restricting members 22 may be biased in the direction indicated by the arrow D by a biasing member (not illustrated), such as a spring.

By the movement of the restricting members 22 in the direction indicated by the arrow D, the cartridge 200 is no longer restricted. Thus, the pressing member 25 presses the surface 200*a* of the cartridge 200 in the direction indicated by the arrow A, and the cartridge 200 moves in the direction indicated by the arrow E, that is, in the mounting direction. As a result, the positioning bosses 20 of the cartridge 200 are positioned at the recesses 21*b* of the guide member 21. Thus, the cartridge 200 is mounted at the image forming position with the photosensitive drum 1 in contact with the transfer roller 2.

After the restricting members 22 move in the direction indicated by the arrow D to the retracted position, the surfaces 22*b* of the restricting members 22 are engaged with step portions 23*c* of the link members 23 so that the restricting member 22 is supported. Thus, the restricting members 22 and the link members 23 that have moved to the retracted positions cannot move to the initial positions illustrated in FIG. 1B. More specifically, the link members 23 at the initial position are biased by the biasing unit to be in contact with the cams 24. However, the link members 23 that have moved to the retracted position where the surfaces 22*b* of the restricting members are engaged with the step portions 23*c* of the link members 23 are prevented from moving back to the initial position. At the retracted position, the surfaces 22*c* of the restricting members 22 become continuous with the guide surfaces 21*a* of the positioning bosses 20 of the cartridge 200. Thus, the restricting members 22 do not restrict the cartridge 200.

As illustrated in FIG. 1A, when the cartridge 200 is at the image forming position, a gap is provided between a surface 25*a* of the pressing member 25 and the surface 200*a* of the cartridge 200. Thus, unnecessary load is not applied to the cartridge 200 at the image forming position.

As described above, when the image forming apparatus 100 is transported, the cartridge 200 is firmly fixed at the transportation position that is at an intermediate portion in the mounting path by the restricting members 22 and the pressing member 25. Thus, the photosensitive drum 1 and the transfer roller 2 can be separated from each other so that no nip portion will be formed therebetween. At the same time, the interface portions (not illustrated), such as electrical contact portions of the apparatus main body 300 and the cartridge 200 can be separated from each other. As a result, the image forming apparatus 100 can be transported without causing any damage to the interface portions, such as the photosensitive drum, the transfer roller, the electrical contact portions, and the like. When the image forming apparatus 100 is used, the user only needs to turn on the image forming apparatus 100 to release the cartridge 200 that has been fixed, so that the cartridge 200 can be mounted at the image forming position by the pressing member 25. As described above, when the image forming apparatus 100 is used, the cartridge 200 can be surely mounted at the image forming position without requiring the user to perform a special operation.

Next, a second exemplary embodiment of the present invention will be described with reference to FIGS. 5A and 5B.

In the description below, components and functions that are the same as those in the first exemplary embodiment will not be described, and only a featured portion of the present exemplary embodiment will be described. The components that are the same as those described in the first exemplary embodiment are denoted with the same reference numerals.

Figure 5A:
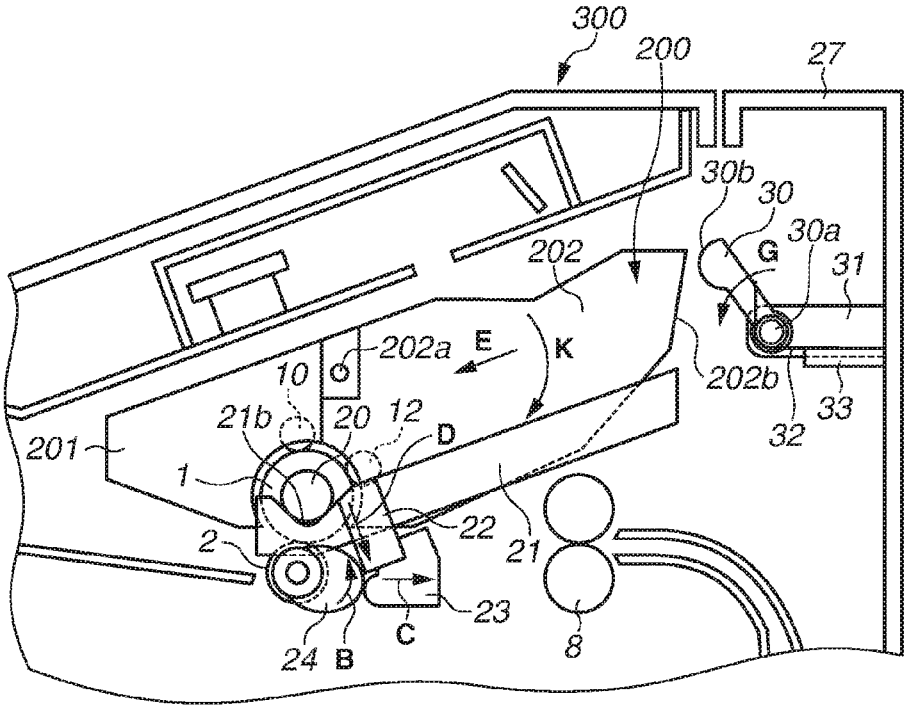
FIGS. 5A and 5B are schematic cross-sectional views each illustrating a configuration in which an image forming apparatus according to a second exemplary embodiment holds a cartridge.
Figure 5B:
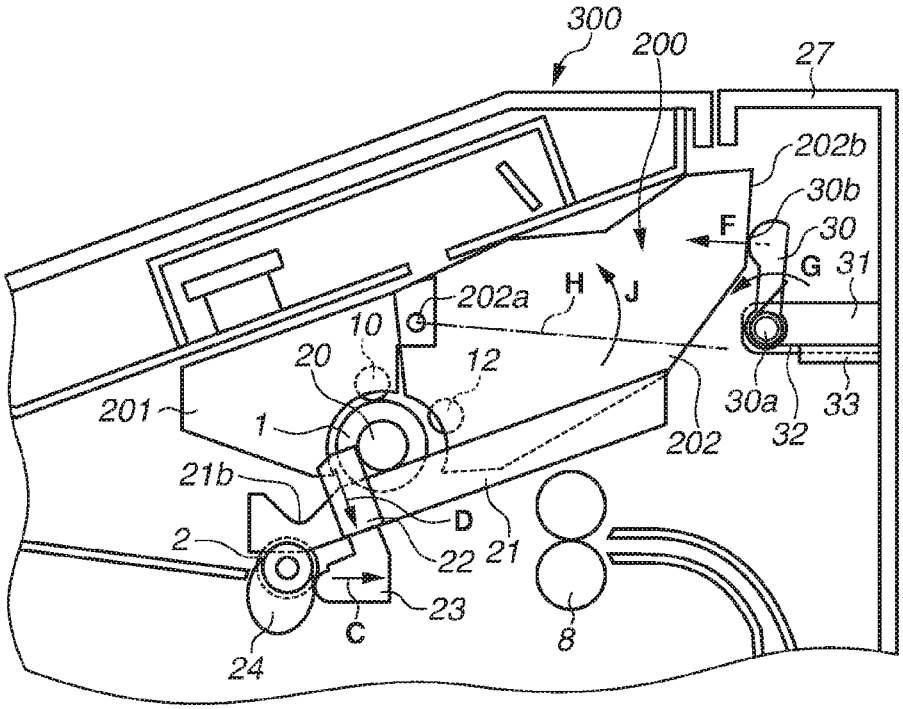

FIGS. 5A and 5B are cross-sectional views each illustrating a configuration in which the apparatus main body 300 according to the present exemplary embodiment holds the cartridge 200. FIG. 5A illustrates the state of when the image forming apparatus 100 is used, and FIG. 5B illustrates the state of when the image forming apparatus 100 is transported. As illustrated in FIGS. 5A and 5B, the cartridge 200 includes a charging container 201, which includes the photosensitive drum 1 and the charging roller 10 serving as a charging device, and a developing container 202 including the developing roller 12 serving as a developing device. The developing container 202 is biased in a direction indicated by an arrow K about a rotational center 202*a* by a biasing unit (not illustrated), and is positioned in a manner such that the developing roller 12 comes into contact with the photosensitive drum 1.

Next, a configuration in which the apparatus main body 300 holds the cartridge 200 when the image forming apparatus 100 is transported will be described. A pressing lever 30, for pressing a surface 202*b* of the developing container 202 on the downstream side E in the mounting direction, is provided to the door 27 of the apparatus main body 300. The pressing lever 30 has a shaft 30*a* held by a holding unit 31 disposed on the door 27, and is rotatable about the shaft 30*a*.

The door 27 is further provided with a torsion coil spring 32 and a spring supporting portion 33 that supports the coil spring 32, and thus the pressing lever 30 is biased in a direction indicated by an arrow G. The developing container 202, that is, the cartridge 200 can be pressed in the direction indicated by the arrow E, which is the mounting direction by a biasing force F with the pressing lever 30 biased in the direction indicated by the arrow G.

The biasing force F is a force pushing the surface 202*b* of the developing container 202 by a surface 30*b* of the pressing lever 30. The biasing force F is acted on the portion above a dotted line H, which is a straight line passing through the center of the rotational center 202*a* and is in parallel with the biasing force F, and thus a moment in a direction indicated by an arrow J is produced in the developing container 202. Thus, the biasing force F applied by the pressing lever 30 also serves as a force for rotating the developing container 202 in the direction indicated by the arrow J. As a result, the developing roller 12 is separated from the photosensitive drum 1. More specifically, the developing container 202 is rotated in the direction indicated by the arrow J by the biasing force F applied by the pressing lever 30, and once the gap between the developing roller 12 and the photosensitive drum 1 reaches a predetermined width, the developing container 202 comes into contact with the charging container 201 (not illustrated in the figure) so that rotation any further in the direction indicated by the arrow J is restricted.

As described above, the cartridge 200 is fixed at the transportation position, at an intermediate portion of the mounting path, with the positioning bosses 20 of the cartridge 200 restricted by the restricting members 22 and the developing container 202 pressed in the direction of the biasing force F by the pressing lever 30. Furthermore, at the transportation position, the developing container 202 is rotated by the direction indicated by the arrow J by the pressing lever 30, whereby the developing roller 12 and the photosensitive drum 1 can be separated from each other.

Next, the operation of pressing the cartridge 200 when the image forming apparatus is used will be described. The operations performed by the restricting members 22, the link members 23, and the cams 24 are the same as those in the first exemplary embodiment. The cartridge 200 moves in the direction indicated by the arrow E with the surface 202*b* of the developing container 202 pressed by the pressing lever 30. Then, the cartridge 200 is mounted at the image forming position with the positioning bosses 20 of the cartridge 200 positioned in the recesses 21*b* of the guide member 21, whereby the photosensitive drum 1 is in contact with the transfer roller 2.

As illustrated in FIG. 5A, a gap is provided between the surface 30*b* of the pressing lever 30 and the surface 202*b* of the developing container 202. Thus, the developing container 202 rotates in the direction indicated by the arrow K about the rotation center 202*a*, and thus the developing roller 12 returns to the state in which the developing roller 12 is in contact with the photosensitive drum 1.

As described above, when the image forming apparatus 100 is transported, the cartridge 200 is firmly fixed at the transportation position, at an intermediate portion in the mounting path, by the restricting members 22 and the pressing member 25. Thus, the photosensitive drum and the transfer roller 2 can be separated from each other so that no nip portion will be formed therebetween. At the same time, the interface portions (not illustrated), such as electrical contact portions of the apparatus main body 300 and the cartridge 200 can be separated from each other. Furthermore, in the present exemplary embodiment, the developing roller 12 and the photosensitive drum 1 can also be separated from each other. As a result, the image forming apparatus 100 can be transported without causing any damage to the interface portions, such as the photosensitive drum 1, the transfer roller 2, the developing roller 12, the electrical contact portions, and the like. On the other hand, when the image forming apparatus 100 is used, the user only needs to turn on the image forming apparatus 100 to release the cartridge 200 that has been fixed, so that the cartridge 200 can be mounted at the image forming position by the pressing member 25. As described above, when the image forming apparatus 100 is used, the cartridge 200 can be surely mounted at the image forming position without requiring the user to perform a special operation.

Figure 6A:
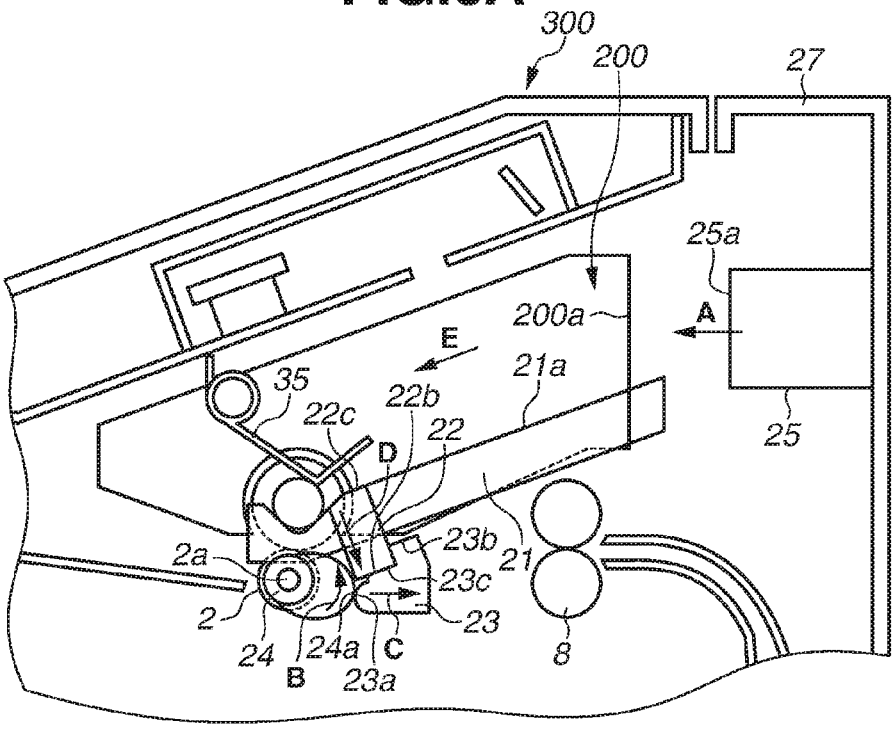
FIGS. 6A and 6B are schematic cross-sectional views each illustrating a configuration in which an image forming apparatus according to a modification holds a cartridge.
Figure 6B:
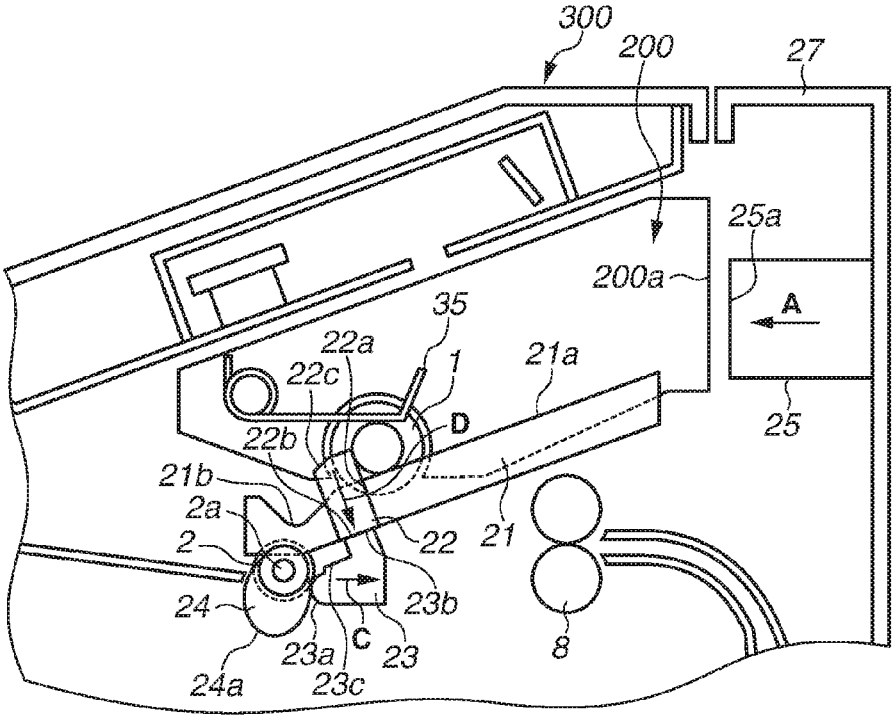

The pressing unit is not limited to the pressing member 25 and the pressing lever 30 provided to the door 27 as in the exemplary embodiments described above. For example, as illustrated in FIGS. 6A and 6B, a pressing spring 35 may be disposed in the apparatus main body 300. FIGS. 6A and 6B are schematic cross-sectional views each illustrating a configuration in which the apparatus main body 300 according to a modification holds the cartridge 200. FIG. 6A illustrates the state of when the image forming apparatus 100 is used, and FIG. 6B illustrates the state of when the image forming apparatus 100 is transported. In this configuration, the pressing spring 35 comes into contact with the cartridge 200, and biases the cartridge 200 in the mounting direction. In the present modification, the pressing spring 35 presses the shaft portion 2*a* of the transfer roller 2 to bias the cartridge 200 in the mounting direction.

As described above, even with the configuration in which the pressing member 25 or the pressing lever 30 is not provided to the door 27, the cartridge 200 can be firmly fixed at the transportation position, which is at an intermediate portion of the mounting path, by the restricting members 22 and the pressing spring 35. Thus, as in the first and the second exemplary embodiments, the photosensitive drum 1 and the transfer roller 2 are separated from each other and the image forming apparatus 100 can be transported without causing any damage to the photosensitive drum 1 and the transfer roller 2. Furthermore, the present modification has a feature in that the door 27 is not provided with the pressing member 25 or the pressing lever 30 unlike the first and the second exemplary embodiments and thus the door 27 can be closed with a small amount of force.

As described above, the present invention can be modified in various ways. The cams 24, which are held by the transfer roller 2 according to the exemplary embodiments described above, may be held by a movable member, such as the registration roller 8 and other conveyance rollers, provided to the apparatus main body 300, or a shaft dedicated for the cams 24 may be provided. The present invention is not limited to the configuration described above in which the driving unit 40 applies driving force to the transfer roller 2, and the driving unit 40 may apply the driving force to the restricting members 22 directly or indirectly through a movable member provided to the apparatus main body 300. More specifically, the driving unit 40 may move the restricting members 22 by moving the movable member. The restricting members 22, the link members 23, and the cams 24, which are disposed on both sides of the cartridge 200, may alternatively be disposed only on a single side as long as the cartridge 200 can be stably fixed. Furthermore, the present invention is not limited to the configuration in the exemplary embodiments described above in which the gap is provided between the surface 25*a* of the pressing member

25 and the surface 200*a* of the cartridge 200 when the cartridge 200 is mounted at the image forming position, and the gap may not be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-254469, filed Dec. 16, 2014, which is hereby incorporated by reference herein in its entirety.

What is claimed is:

1. An image forming apparatus that is transportable in a state in which a cartridge that is detachably attached to a main body of the image forming apparatus is mounted, the image forming apparatus comprising:

an opening and closing member that is able to be opened and closed when the cartridge is attached and detached;

a restricting member configured to prevent the cartridge, which is inserted through an opening portion of the main body, from being inserted to an image forming position at which the cartridge performs image forming, the opening portion being formed by an opening of the opening and closing member;

a driving unit configured to move the restricting member; and a pressing unit configured to press the cartridge in a direction in which the cartridge is mounted at the image forming position, wherein the cartridge is, when the image forming apparatus is transported, fixed at a transportation position which is different from the image forming position so as to be urged to the restricting member by the pressing unit, and wherein the restricting member is, when the image forming apparatus is used, moved to a retracted position by the driving unit and the cartridge is movable to the image forming position.

2. The image forming apparatus according to claim 1, further comprising a guide member configured to guide the cartridge when the cartridge is attached to and detached from the image forming apparatus through the opening portion, wherein the restricting member is configured to prevent the cartridge, which is guided by the guide member, from being inserted to the image forming position.

3. The image forming apparatus according to claim 1, wherein the cartridge includes an image bearing member and a developing device configured to develop an electrostatic latent image formed on the image bearing member, and wherein, when the cartridge is at the transportation position, the developing device is pressed by the pressing unit to be separated from the image bearing member, and when the cartridge is at the image forming position, the developing device is in contact with the image bearing member.

4. The image forming apparatus according to claim 1, wherein the pressing unit is disposed on the opening and closing member.

5. The image forming apparatus according to claim 4, wherein the pressing unit does not press the cartridge when the cartridge is at the image forming position.

6. The image forming apparatus according to claim 1, wherein the pressing unit is a spring configured to press the cartridge to a direction to be mounted at the image forming position by coming into contact with the cartridge.

7. The image forming apparatus according to claim 1, wherein the driving unit is configured to move a movable member so that the movable member moves the restricting member.

* * * * *